US011465415B2

(12) United States Patent
Kurashima et al.

(10) Patent No.: US 11,465,415 B2
(45) Date of Patent: Oct. 11, 2022

(54) LIQUID EJECTION MODULE

(71) Applicant: CANON KABUSHIKI KAISHA, Tokyo (JP)

(72) Inventors: Rei Kurashima, Kanagawa (JP); Hiroyuki Ozaki, Kanagawa (JP); Toru Nakakubo, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/348,633

(22) Filed: Jun. 15, 2021

(65) Prior Publication Data

US 2021/0394515 A1 Dec. 23, 2021

(30) Foreign Application Priority Data

Jun. 19, 2020 (JP) ..... JP2020-106032

(51) Int. Cl.
*B41J 2/14* (2006.01)
*B41J 2/19* (2006.01)

(52) U.S. Cl.
CPC ..... *B41J 2/1404* (2013.01); *B41J 2/14145* (2013.01); *B41J 2/19* (2013.01); *B41J 2/14298* (2013.01); *B41J 2002/14306* (2013.01); *B41J 2002/14403* (2013.01); *B41J 2002/14419* (2013.01); *B41J 2202/07* (2013.01)

(58) Field of Classification Search
CPC ..... B41J 2/1404; B41J 2/14145; B41J 2/19; B41J 2/14298; B41J 2002/14306; B41J 2002/14403; B41J 2002/14419; B41J 2202/07; B41J 2/18
See application file for complete search history.

(56) References Cited

U.S. PATENT DOCUMENTS 10,300,707 B2 * 5/2019 Nakakubo ..... B41J 2/18

FOREIGN PATENT DOCUMENTS

WO 2013/032471 A1 3/2013

* cited by examiner

*Primary Examiner* — Geoffrey S Mruk
(74) *Attorney, Agent, or Firm* — Canon U.S.A., Inc. IP Division

(57) ABSTRACT

In a case where air bubbles exist in ink at the time of circulating the ink within a liquid ejection module, the amount circulating ink runs short and stability of ejection is blocked. The liquid ejection module has: a pressure chamber that communicates with an ejection port and which stores a liquid; an energy generation element that produces energy for causing a liquid to be ejected from the ejection port; a supply flow path that supplies a liquid to the pressure chamber; a collecting channel that collects a liquid from the pressure chamber; a liquid sending chamber that connects to the collecting channel; a connection flow path that connects the liquid sending chamber and the supply flow path; and a liquid sending unit configured to circulate a liquid, and the liquid sending chamber has a continuously inclined structure.

10 Claims, 11 Drawing Sheets

LIQUID EJECTION MODULE

BACKGROUND

Field of the Disclosure

The present disclosure relates to a liquid ejection module,

Description of the Related Art

In a liquid ejection module, such as an ink jet print head, there is a case where evaporation of a volatile component advances at the ejection port at which the ejection operation is not performed for a while and the liquid (ink) degenerates, In this case, the ink ejection amount and the ejection direction vary and there is a possibility that density unevenness, streaks, or the like occurs in a formed image. in order to suppress the degeneration of ink such as this, in recent years, a method has been proposed that supplies fresh ink to the ejection port at all times by circulating ink within the liquid ejection module.

International Publication No. 2013/032471 has disclosed a liquid ejection module having a configuration in which ink circulation is facilitated at the position very close to the ejection port by arranging an actuator at the position adjacent to the energy generation element for ejection.

Incidentally, in a case where the ejection operation is performed continuously, it may happen sometimes that the temperature of the circuit substrate of the liquid ejection module rises and the ink within the flow path adjacent thereto is heated. In this case, it may happen sometimes that the oxygen dissolved and existing in the ink evaporates and air bubbles occur in the ink. Further, there is a case where air bubbles enter the ink in a mixed manner from the outside for some reason. In a case where the air bubbles stagnate in the flow path, the flow path resistance increases and there is a possibility that the amount of ink that is supplied to a pressure chamber having an energy generation element and an ejection port runs short. Further, there is a possibility that a pressure loss occurs in the drive of the actuator that circulates ink and the amount of circulating ink runs short. As a result of that, a concern arises that stability of ejection is impeded in the ejection operation immediately after suspension and the continuous ejection operation.

However, the liquid ejection module described in international Publication No. 2013/032471 has the flow path with a structure that is perpendicular to the buoyancy direction and which is long, and therefore, there is such a problem that the air bubbles that occur in the ink and air bubbles that enter the ink in a mixed manner are likely to stagnate within the flow path.

SUMMARY

Consequently, in view of the above-described problem, one embodiment of the present disclosure is to provide a liquid ejection module capable of performing a stable ejection operation by discharging air bubbles from the flow path while circulating and supplying fresh ink in the vicinity of an ejection port.

One embodiment of the present disclosure is a liquid ejection module including a pressure chamber that communicates with an ejection port and which stores a liquid ejected from the ejection port; an energy generation element that is provided in the pressure chamber and which produces energy for causing a liquid to be ejected from the ejection port; a supply flow path that supplies a liquid to the pressure chamber; a collecting channel that collects a liquid from the pressure chamber; a liquid sending chamber that connects to the collecting channel; a connection flow path that connects the liquid sending chamber and the supply flow path; and a liquid sending unit configured to circulate a liquid in the supply flow path, the pressure chamber, the collecting channel, the liquid sending chamber, and the connection flow path by expanding and contracting a volume of the liquid sending chamber, and the liquid sending chamber has a continuously inclined structure, in the liquid. sending chamber, a cross-sectional area in a cross section parallel to a plane perpendicular to a gravity direction becomes smaller along a direction opposite to the gravity direction, and a portion at which the cross-sectional area becomes the smallest is a portion that connects to the connection flow path.

Further features of the present disclosure will become apparent from the following description of exemplary embodiments with reference to the attached drawings.

Figure 9:
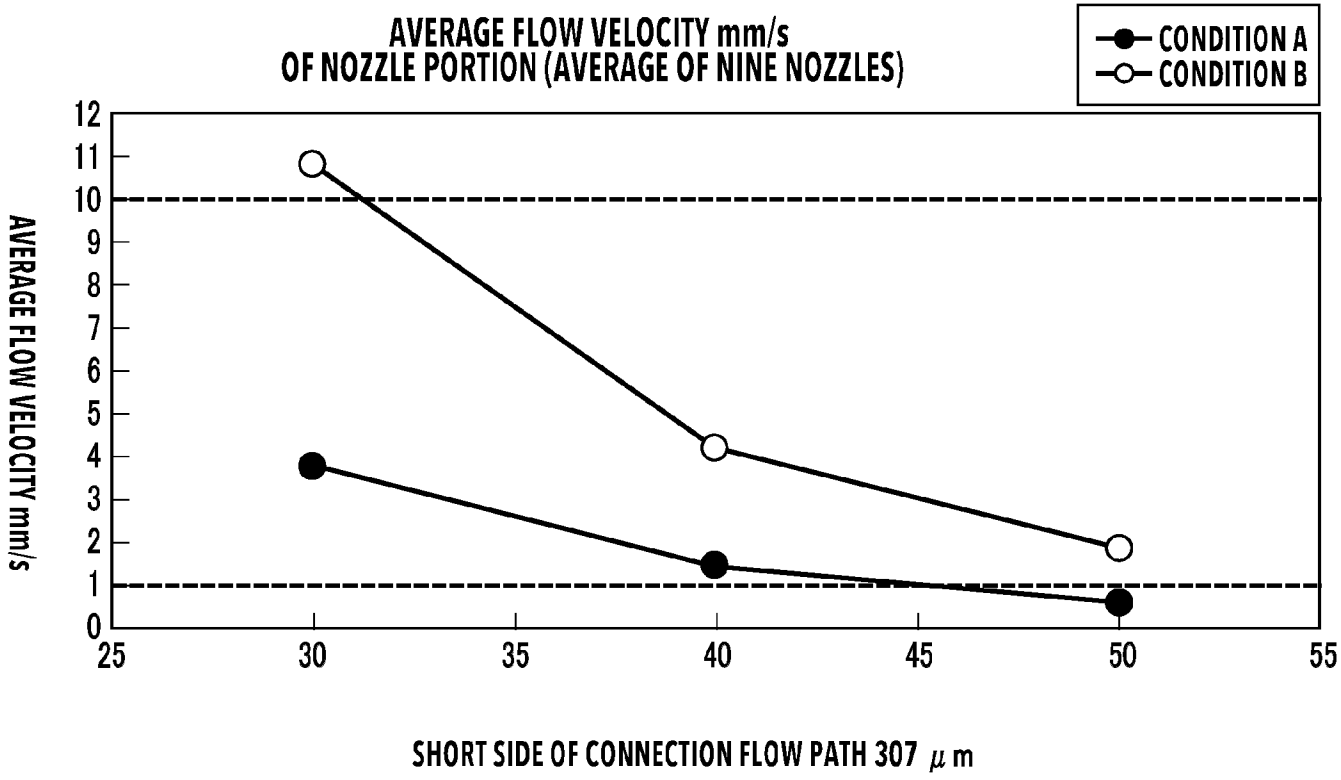
Figure 10:
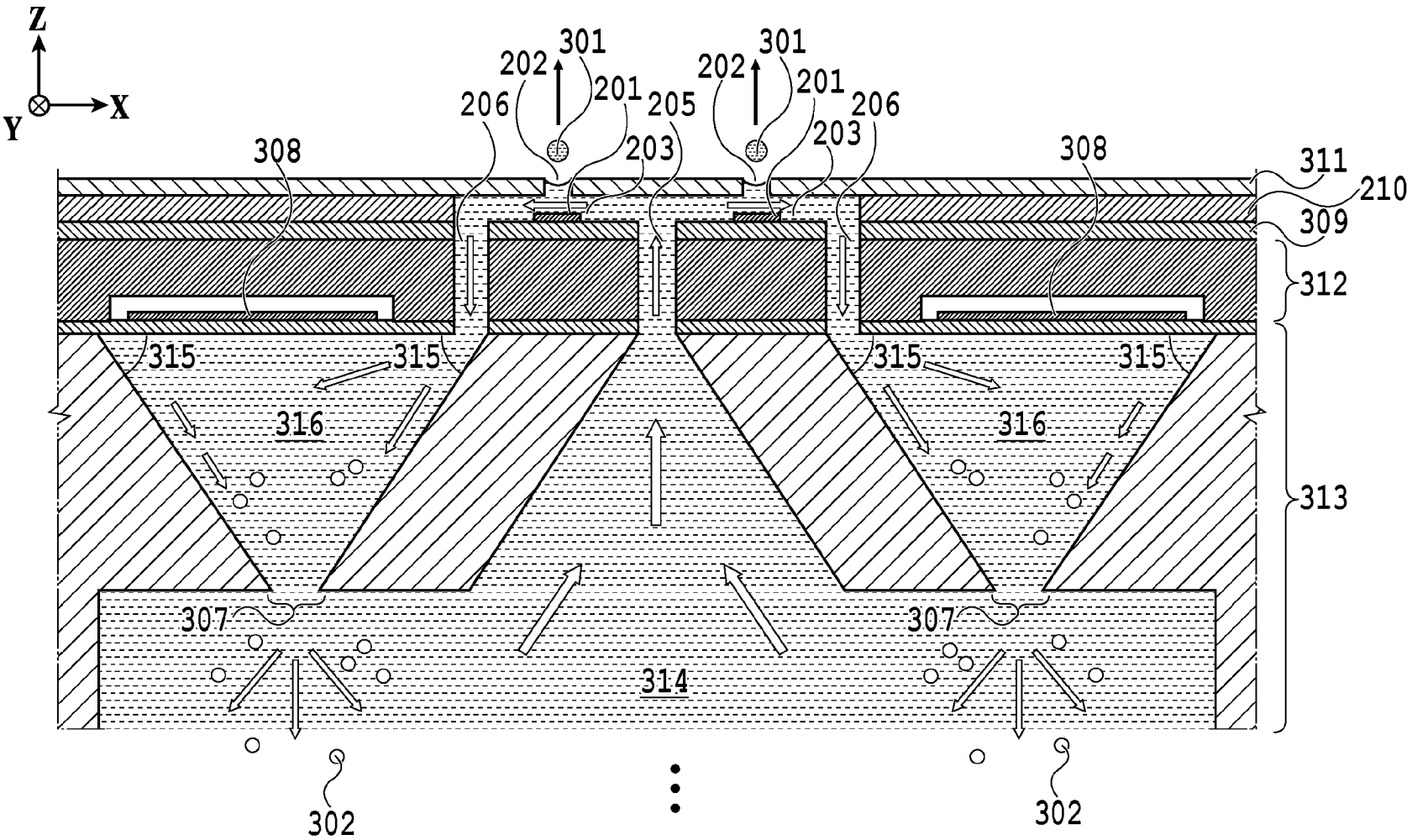
Figure 11:
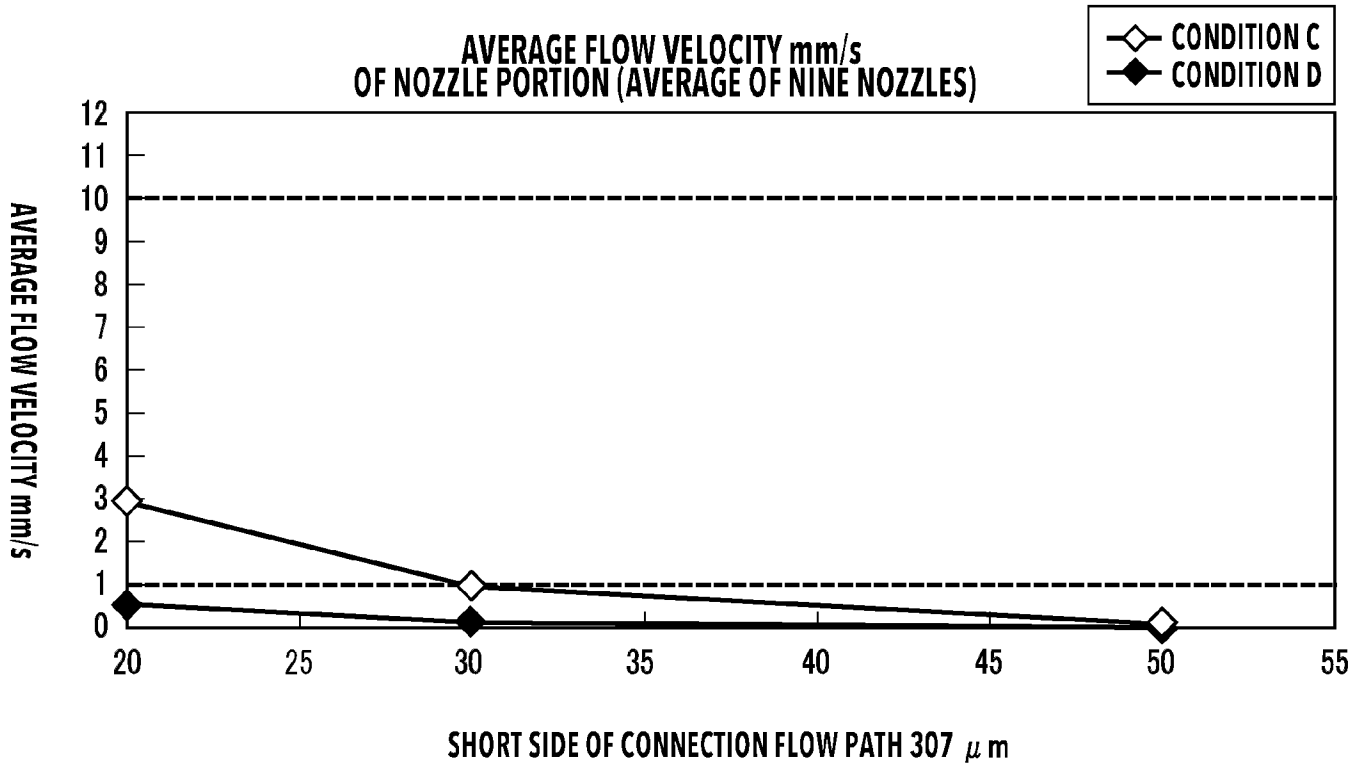

FIG, 8 is a diagram showing a relationship between a size of an area that contributes to a displacement in the liquid sending mechanism and a size of an opening of a connection flow path in the first embodiment;

FIG. 9 is a diagram showing a relationship between an opening shape of the connection flow path and an average flow velocity of ink in the vicinity of nine ejection ports in the first embodiment;

FIG. 10 is a cross-sectional diagram of a printing element substrate in a second embodiment; and FIG. 11 is a diagram showing a relationship between an opening shape of a connection flow path and an average flow velocity of ink in the vicinity of nine ejection ports in the second embodiment.

DESCRIPTION OF THE EMBODIMENTS

In the following, with reference to the drawings, preferred embodiments of the present disclosure are explained in detail. Contents, relative arrangement and the like of components described below are not intended to limit the scope of the present disclosure only to those unless particularly described.

In the present disclosure, in order to solve the above-described problem, the liquid ejection module of the present disclosure has a structure in which the sidewall of a liquid sending chamber 316 has a continuous inclination and the space of the liquid sending chamber 316 is narrowed along the direction (buoyancy direction) opposite to the gravity direction. As a result of this, air bubbles 302 in ink rise by the buoyancy, but are not trapped by wall surface because of the continuous inclination of the sidewall and discharged from the liquid sending chamber 316. The present disclosure is characterized in that the air bubbles 302 do not stagnate in the liquid sending chamber 316 and ink can circulate stably.

First Embodiment

<External Appearance of Ink Jet Print Head>

Figure 1:
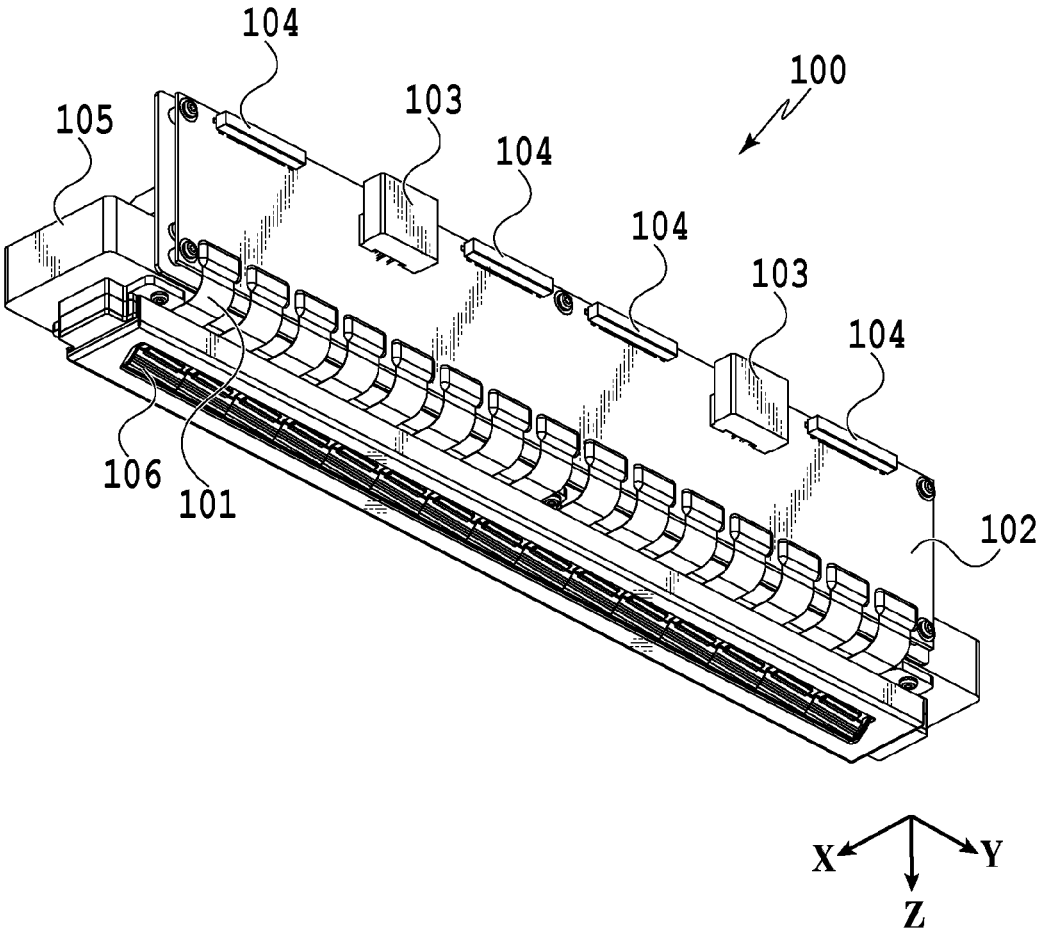
FIG. 1 is a perspective diagram of an ink jet print head in a first embodiment.

In the following, a liquid ejection module in the present embodiment, specifically, an ink jet print head 100 (in the following, simply called print head 100) is explained by using FIG 1. FIG. 1 is a perspective diagram of the print head 100 in the present embodiment, The print head 100 has a flexible wiring substrate 101, an electrical wiring substrate 102, a power supply terminal 103, a signal input terminal 104, an ink supply unit 105, and a printing element substrate 106.

Here, in the print head 100, the direction in which the printing element substrate 106 is arrayed is taken as the Y-direction. Further, the direction in which ink is ejected is taken as the Z-direction. Furthermore, the direction perpendicular to the Y-direction and the Z-direction is taken as the X-direction.

The print head 100 has the printing element substrate 106 including a plurality of printing elements arrayed in the Y-direction. Here, the printing element is an element that combines an ejection port 202, an energy generation element 201, and a pressure chamber 203, to be described later (see FIG. 2). A plurality of the printing element substrates 106 is arrayed in the Y-direction. Here, the print head 100 of full-line type is configured by the printing element substrates 106 being arrayed in the Y-direction along a distance corresponding to the width of the A4 size.

Each printing element substrate 106 is connected to the electrical wiring substrate 102 via the flexible wiring substrate 101. The electrical wiring substrate 102 has the power supply terminal 103 for receiving electric power and the signal input terminal 104 for receiving an ejection signal. In the ink supply unit 105, a circulation flow path is formed and via this circulation flow path, ink is supplied to each printing element substrate 106 from an ink tank, not shown schematically. Further, via this circulation flow path, the ink that is not consumed at the time of the printing processing is collected.

Each printing element arranged on the printing element substrate 106 ejects the ink supplied from the ink supply unit 105 in the Z-direction by using the electric power supplied from the power supply terminal 103 based on the ejection signal that is input from the signal input terminal 104.

<Flow Path Configuration of Printing Element Substrate>

Figure 2:
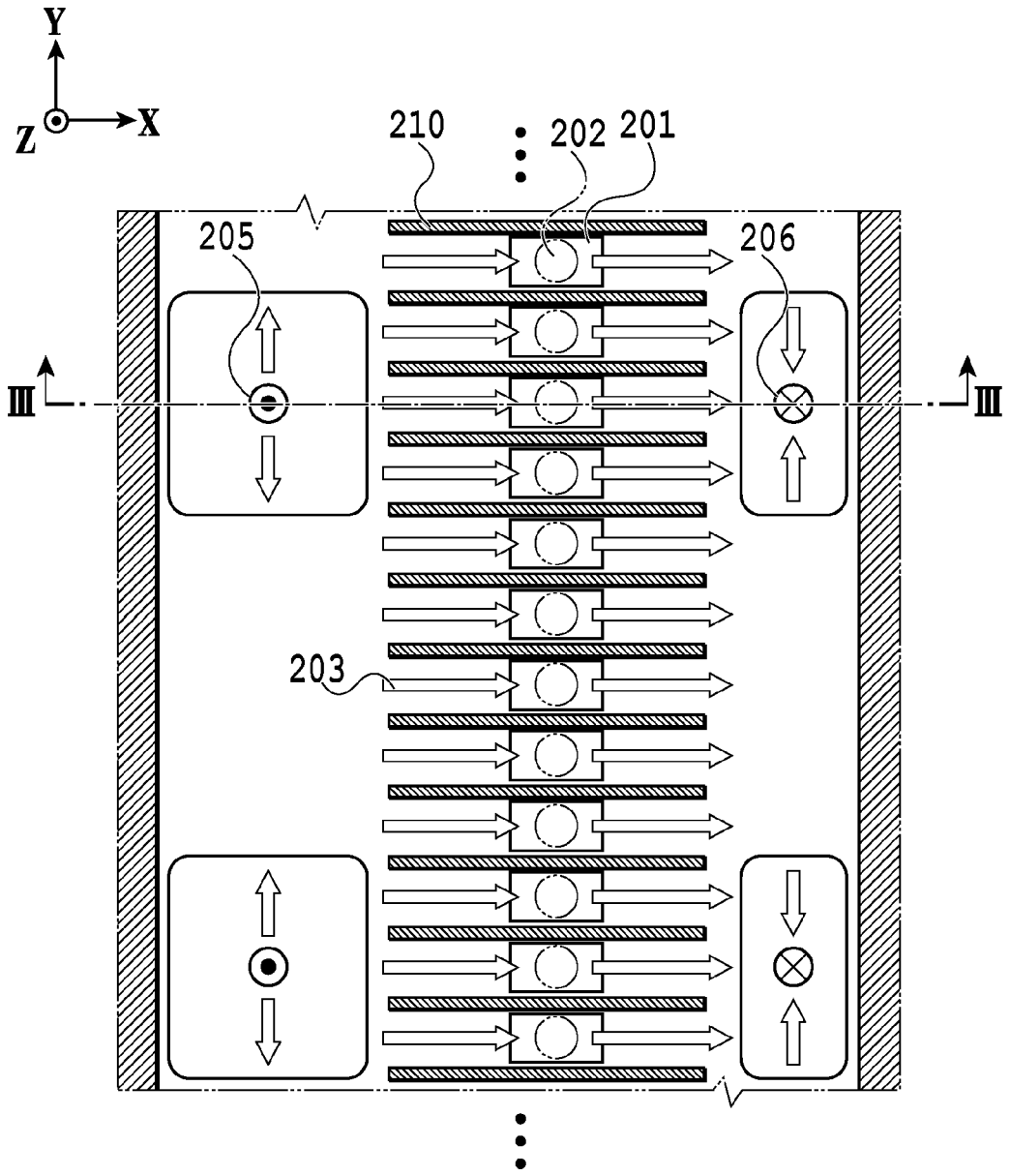
FIG. 2 is a plan perspective diagram of a printing element substrate in the first embodiment.
Figure 3:
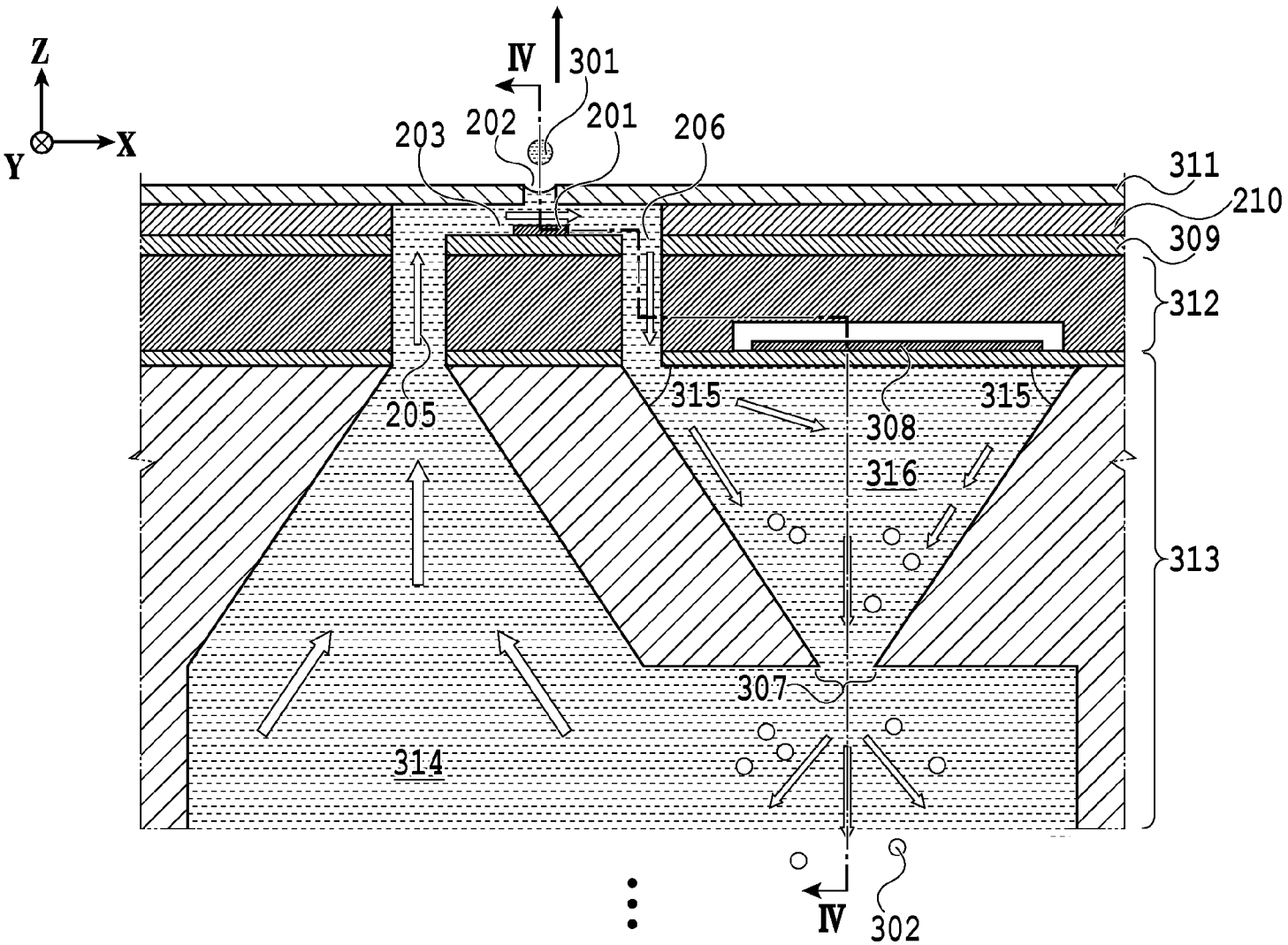
FIG. 3 is a cross-sectional diagram of the printing element substrate in the first embodiment.
Figure 4:
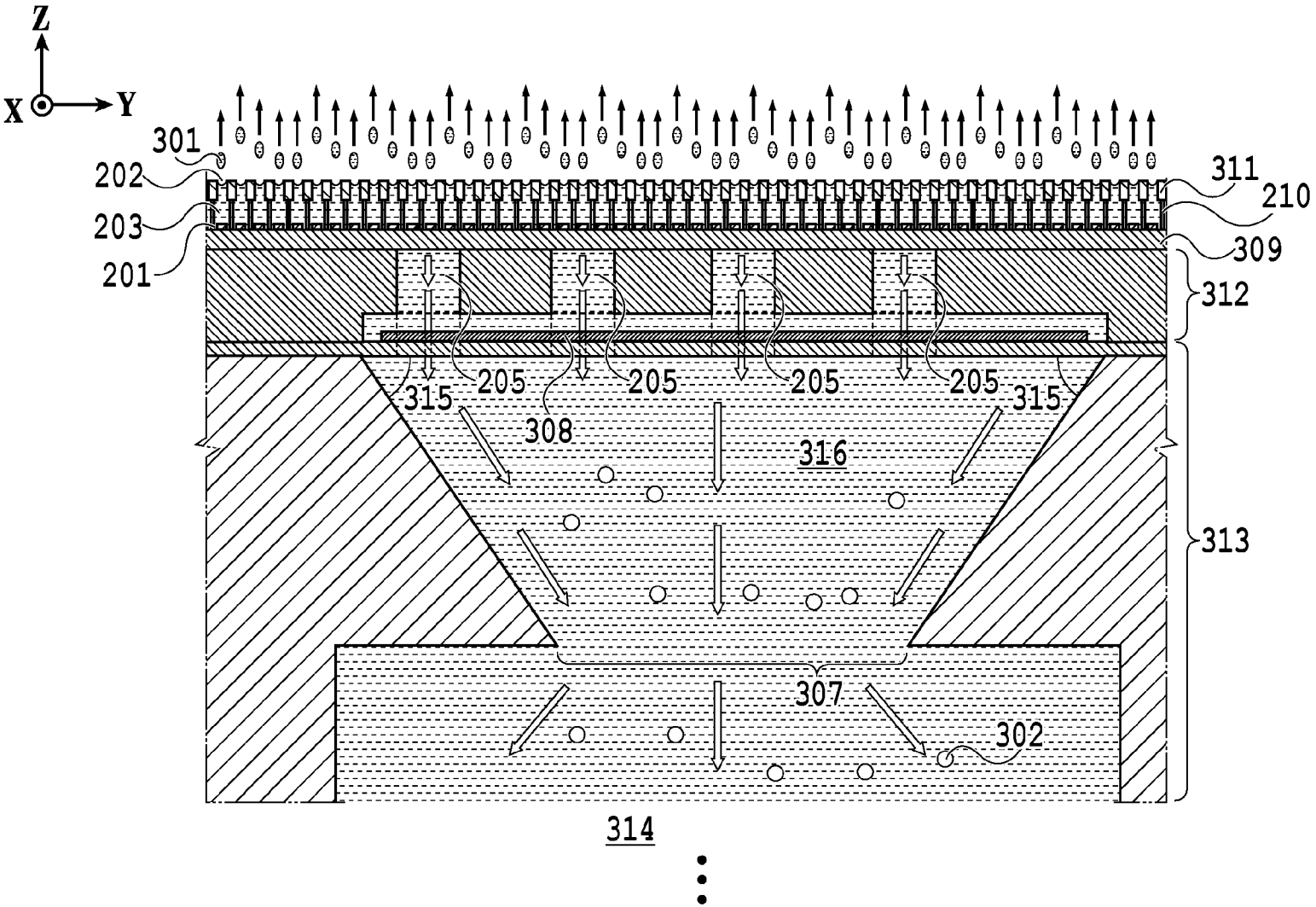
FIG. 4 is a cross-sectional diagram of the printing element substrate in the first embodiment.

FIG. 2, FIG. 3, and FIG. 4 are each a diagram showing a part of the flow path configuration of the printing element substrate 106. FIG. 2 is a plan perspective diagram in a case where the printing element substrate 106 is viewed form the side facing the ejection port 202. As shown in FIG. 2, the printing element substrate 106 in the present embodiment has the energy generation element 201, the ejection port 202, the pressure chamber 203, a supply flow path 205, and a collecting channel 206.

As shown in FIG. 2, on the printing element substrate 106, a predetermined number (for example, about several tens) of printing elements is arranged adjacent to one another in the Y-direction. Each printing element is separated by a flow path forming member 210. The one supply flow path 205 is arranged for several printing elements and supplies ink to these several printing elements. The collecting channel 206 collects ink from the printing elements corresponding in number to the number of printing elements to which the supply flow path 205 supplies ink. The one flow path block includes the predetermined number of printing elements described previously, the plurality of the supply flow paths 205 supplying ink to these printing elements, and the plurality of the collecting channels 206 collecting ink from these printing elements. The ink supplied from the ink supply unit 105 passes through the circulation flow path prepared for each flow path block and circulates within the printing element substrate 106. Further, a liquid sending mechanism 308, to be described later, is provided for each flow path block (see FIG. 3).

FIG. 3 is a cross-sectional diagram of the printing element substrate 106 along a III-III line in FIG. 2. As shown in FIG. 3, the printing element substrate 106 in the present embodiment has a second substrate 313, a first substrate 312, a function layer 309, the flow path forming member 210, and an ejection port forming member 311. The printing element substrate 106 is formed by laminating these components in this order in the Z-direction. On the surface of the function layer 309, the energy generation element 201, which is an electrothermal conversion element, is arranged. In the ejection port forming member 311, at the position at which it overlaps the energy generation element 201 in the Z-direction, the ejection port 202 is formed. A plurality of the enemy generation elements 201 is arrayed in the Y-direction see FIG. 2) and each of the energy generation elements 201 is isolated by the flow path forming member 210 that intervenes between the function layer 309 and the ejection port forming member 311. Due to this, the pressure chamber 203 corresponding to each of the energy generation elements 201 and the ejection ports 202 is formed.

The ink stored in the pressure chamber 203 forms a meniscus at the position of the ejection port 202 in the stable state. In a case where a voltage pulse is applied to the energy generation element 201 in accordance with the ejection signal, film boiling occurs in the ink in contact with the energy generation element 201. As a result of this, the ink foams. At this time, by the growth energy of the bubbles that have occurred, the ink is ejected in the Z-direction (direction of the solid-black arrow in FIG. 3 and FIG. 4) from the ejection port 202 as liquid droplets 301.

As shown in FIG. 3, on the printing element substrate 106 of the present embodiment, the first substrate 312, the second substrate 313, a common supply flow path 314, the function layer 309, the flow path forming member 210, and the ejection port forming member 311 form the circulation flow path, The supply flow path 205 and the collecting channel 206 are shared by a plurality of printing elements within one flow path block and supply and collect the ink for a predetermined number of pressure chambers 203. The collecting channel 206 communicates with the liquid sending chamber 316 in which the liquid sending mechanism 308 is provided without intervention of the pressure chamber 203. The liquid sending chamber 316 communicates with the common supply flow path 314 via a connection flow path 307. The common supply flow path 314 communicates with the supply flow path 205.

Ink circulates from the common supply flow path 314 to the supply flow path 205, from the supply flow path 205 to the pressure chamber 203, from the pressure chamber 203 to the collecting channel 206, from the collecting channel 206 to the liquid sending chamber 316, from the liquid sending chamber 316 to the common supply flow path 314 again via the connection flow path 307. The solid-white arrow in FIG. 3 and FIG. 4 indicates the flow of ink at the time of ink circulation. This ink circulation occurs by the liquid sending mechanism 308 causing the ink to flow.

On the surface on the side of the ejection port 202 of the second substrate 313, the liquid sending mechanism 308 is arranged. The liquid sending mechanism 308 is located at the position on the opposite side of the surface that comes into contact with the function layer 309 on the first substrate 312 and by changing its volume, ink is caused to circulate (see FIG. 5).

FIG. 4 is a cross-sectional diagram of the printing element substrate 106 along a IV-IV line in FIG. 3. The one liquid sending mechanism 308 circulates ink within about fifty printing elements. It may also be possible to provide the one liquid sending mechanism 308 for about several printing elements.

Here, in order to improve the dischargeability of the air bubbles 302, it is preferable to increase the opening of the connection flow path 307. However, according to the liquid sending principle of a valveless pump, as the opening of the connection flow path 307 is increased, it is required to increase the change in the flow rate by the liquid sending mechanism 308. As a result of that, as in the present embodiment, the arrangement area of the liquid sending mechanism 308 becomes large and the number of printing elements in the charge of the one liquid sending mechanism 308 increases.

In the configuration such as this, the ink supplied by the ink supply unit 105 via the common supply flow path 314 circulates within the printing element substrate 106 in order of the supply flow path 205, the pressure chamber 203, the collecting channel 206, the liquid sending chamber 316, and the connection flow path 307. In a case where the ink within the pressure chamber 203 is consumed by the ejection operation, new ink is supplied to the ejection port 202 and the meniscus is formed again. Even though the ejection operation is not performed, the circulation described previously is performed and to the vicinity of the ejection port 202, fresh ink is supplied at all times. Although not shown schematically, it is preferable to provide a filter within the supply flow path 205 for preventing foreign matter and the air bubbles 302 from flowing in. As the filter, for example, a cylindrical structure or the like is adopted.

The printing element substrate 106 is manufactured by pasting the first substrate 312 and the second substrate 313, on which structures are formed in advance. The connection flow path 307 is formed by performing etching from both surfaces of the substrate, which is the material, at the time of manufacturing the second substrate 313. It is preferable to form the liquid sending chamber 316 and the like on the second substrate 313 by anisotropic etching for a (100 plane) Si single crystal substrate, including the formation of the continuously inclined structure in the liquid sending chamber 316.

<Structure of Liquid Sending Chamber>

The reason the sidewall of the liquid sending chamber 316 is formed into a continuously inclined structure in the present embodiment is described. In a case where a device mounting the print head 100 performs the continuous ejection operation, the circuit substrate of the print head 100 produces heat. As a result of that, the ink within the print head 100 is heated and the temperature of the ink rises. In a case where the temperature of the ink rises, the oxygen dissolved and existing in the ink vaporizes and the minute air bubbles 302 become likely to occur in the ink. The minute air bubbles 302 that occur in this manner unite and grow into the air bubbles 302 whose size is large. In a case where the air bubbles 302 stagnate in the liquid sending chamber 316, the pressure to the ink by the liquid sending mechanism 308 is absorbed by the air bubbles 302, and therefore, the flow rate of the ink at the time of ink circulation is reduced. Further, in a case where the volume of the grown air bubbles 302 becomes close to the amount of displacement of the liquid sending mechanism 308, the circulation of the ink stops completely.

From this, it is indispensable for the air bubbles 302 having occurred in ink to be discharged to the outside of the liquid sending chamber 316 without stagnating within the liquid sending chamber 316. Because of this, in the present embodiment, the sidewall of the liquid sending chamber 316 is formed into a continuously inclined structure with no step. This inclined structure is formed so that the cross-sectional area in the cross section in parallel to the plane perpendicular to the gravity direction in the liquid sending chamber 316 becomes smaller toward the direction opposite to the gravity direction (direction of buoyancy received by the air bubbles 302). Due to this, the air bubbles 302 that rise by the buoyancy are suppressed from being trapped by the sidewall of the liquid sending chamber 316. At the endmost portion of the inclined structure of the liquid sending chamber 316, the connection flow path 307 is provided. The connection flow path 307 connects the liquid sending chamber 316 and the common supply flow path 314. The cross-sectional area of the liquid sending chamber 316 described previously becomes the smallest at the portion (connection flow path 307) at which the liquid sending chamber 316 and the common supply flow path 314 are connected with each other. By integrating the connection flow path 307 and the liquid chamber into a single-unit structure, it is possible to form a flow path with no step in the path through which the air bubbles 302 pass.

Even though the air bubbles 302 within the liquid sending chamber 316 are discharged, in a case where the ink circulation operation is performed, new ink in which oxygen is dissolved and in existence flows into the liquid sending chamber 316. Because of this, a configuration becomes necessary in which the air bubbles 302 are discharged actively without the need to perform the ink circulation operation as in the liquid sending chamber 316 and the connection flow path 307 in the present embodiment.

An inclination angle 315 of the wall surface of the liquid sending chamber 316 in FIG. 3 and FIG. 4 is explained, As a result of study, it has been made clear that the inclination angle 315 needs to be about 30° or more. In a case where the inclination angle 315 is small, the buoyancy received by the air bubbles 302 becomes inferior to the frictional force of the sidewall, and therefore, there is a case where the air bubbles 302 stagnate at the flow path sidewall. Although depending on the method of forming the liquid sending chamber 316, in a case where anisotropic etching of a Si single crystal substrate is supposed, the inclination angle 315 is about 54.8°. In this case, the inclined structure of the liquid sending chamber 316 is configured by the (111) plane of the Si single crystal substrate. Here, the inclination angle 315 is supposed to be not less than 30° and not more than 60°.

From the standpoint of prevention of stagnation of the air bubbles 302, the larger inclination angle 315 is preferable, but in a case where the inclination angle 315 becomes large, the distance from the liquid sending mechanism 308 to the connection flow path 307 becomes long. In this case, the volume of the liquid sending chamber 316 increases. In a case where the volume of the liquid sending chamber 316 increases, the compliance (inverse of rigidity) of the liquid sending chamber 316 increases and the frequency response of the entire system is reduced, and therefore, this is not preferable from the standpoint of drive. It is preferable for the inclination angle 315 be 65° or less at most.

Further, as shown in FIG. 3 and FIG. 4, it is preferable that the arrangement relationship between the liquid sending mechanism 308 and the opening position of the connection flow path 307 is such that both face each other with the liquid sending chamber 316 being sandwiched in between. The height of displacement of the liquid sending mechanism 308 is as small as about 1 μm at most. However, in a case where the liquid sending mechanism 308 is required to have the function as a valveless pump on the premise of the flow path configuration in the present embodiment, several tens of pL to 100 pL or more is required as the amount of displacement volume of the liquid sending mechanism 308. Because of this, in order to increase the amount of displacement volume of the liquid sending mechanism 308, it is necessary to increase the installation area of the liquid sending mechanism 308. Because of this, the arrangement area of the liquid sending mechanism 308 becomes large. The interval between ink colors is about 1 mm and it is necessary to arrange the supply flow path 205, the pressure chamber 203, the ejection port 202, the collecting channel 206, the liquid sending mechanism 308, the liquid sending chamber 316, and the connection flow path 307 in that space. In order to secure the arrangement area of the liquid sending mechanism 308 to the maximum, it is preferred to arrange the liquid sending mechanism 308 and the opening position of the connection flow path 307 at the positions facing each other.

The flow in the vicinity of the connection flow path 307 changes violently, and therefore, it is preferable for the connection flow path 307 to be arranged apart from the collecting channel 206 that requires a laminar flow. In a case where the connection flow path 307 and. the collecting channel 206 are in a close arrangement relationship, there is a possibility that the violent flow of the connection flow path 307 affects the gradual flow of the collecting channel 206 and a reduction in the liquid sending performance results. Because of this, it is preferable to arrange the collecting channel 206 so as to be in an arrangement relationship in which the collecting channel 206 is closer to the liquid sending mechanism 308 than to the connection flow path 307. In the present embodiment, the collecting channel 206 is connected to the liquid sending chamber 316 so as to be adjacent to the liquid sending mechanism 308.

Further, it is preferable for the flow path shape of part of the common supply flow path 314 connected to the supply flow path 205 to have a continuously inclined structure with no step. The reason is that the air bubbles 302 become more likely to be trapped in the presence of a step shape. In a case where the minute air bubbles 302 are trapped, they gradually grow into the large air bubbles 302. In a case where the large air bubbles 302 exist on the side of the supply flow path 205, the circulation of ink is blocked. Further, there is also a case where the air bubbles 302 separated from the large air bubbles 302 flow into the pressure chamber 203 and the liquid sending chamber 316.

In order to avoid the situation such as this, it is preferable to form part of the common supply flow path 314 into a shape along the inclination of the wall surface of the adjacent liquid sending chamber 316 also from the standpoint of the space use efficiency. In a case where part of the common supply flow path 314 and the liquid sending chamber 316 are formed by wet etching by an alkali solution for a Si (100) single crystal substrate, the inclination angles 315 of the inclined structure in part of the common supply flow path 314 and the liquid sending chamber 316 coincide with each other with a difference within ±1°. Due to this, part of the common supply flow path 314 is formed as a shape along the wall surface of the adjacent liquid sending chamber 316 as in the present embodiment and substantially parallel to the wall surface of the liquid sending chamber 316. In a case where the angle formed by two structures is ±1°, they are regarded as substantially parallel.

<Configuration of Liquid Sending Mechanism>

Figure 5:
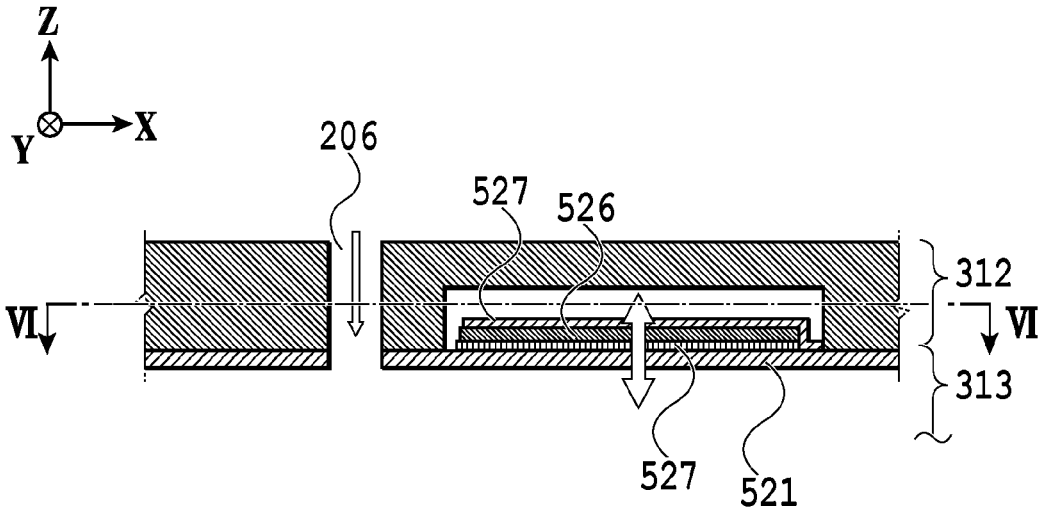
FIG. 5 is a cross-sectional diagram of a printing element substrate 106 including a liquid sending mechanism, a first substrate, and a second substrate in the first embodiment.

In the following, the configuration of the liquid sending mechanism 308 is explained by using FIG.5 and FIG, 6. First, the configuration of the liquid sending mechanism 308 in a case where a thin-film piezoelectric body 526 is used as a pump actuator is explained by using FIG. 5. FIG. 5 is a cross-sectional diagram of the printing element substrate 106 including the liquid sending mechanism 308, the first substrate 312. and the second substrate 313. In the liquid sending mechanism 308, a unimorph piezoelectric actuator is used. The unimorph piezoelectric actuator has a configuration in which the thin-film piezoelectric body 526 that uses a piezoelectric element, an electrostrictive element and the like is formed on one side of a diaphragm 521. In a case where a voltage is applied, the thin-film piezoelectric body 526 displaces the side of the first substrate 312 of the diaphragm 521 and expands and contracts the volume of the liquid sending chamber 316. A bidirectional white-solid arrow in FIG. 5 indicates the direction in which the diaphragm 521 displaces.

The diaphragm 521 is configured so as to separate the liquid sending chamber 316 from the atmosphere side and the thin-film piezoelectric body 526 is arranged on the atmosphere side. On the side of the first substrate 312, a caved structure is provided so as to correspond to the arrangement position of the thin-film piezoelectric body 526 and the first substrate 313 and the second substrate 313 are sealed so as to prevent the outside air and ink from invading the thin-film piezoelectric body 526.

As the diaphragm 521 a silicon nitride film, silicon, metal, heat-resistant glass or the like, which satisfies conditions, such as the necessary mechanical characteristic and reliability.

As the forming method of the thin-film piezoelectric body 526, it is possible to select one of the vacuum sputter film formation, the sol-gel film formation, the CVD film formation and the like. The thin-film piezoelectric body 526 is frequently accompanied by firing after film formation. The thin-film piezoelectric body 526 is formed by firing at about 650° C. at most under the oxygen atmosphere by using lamp annealing heating after film formation. Further, it may also be possible to form the thin-film piezoelectric body 526 by performing direct film formation on the diaphragm 521 and integrated firing in view of the conformity of the process flow. Further, it may also be possible to form the thin-film piezoelectric body 526 by performing film formation on another substrate and firing and then peeling and transferring the thin-film piezoelectric body 526 onto the side of the diaphragm 521. Further, it may also be possible to form the thin-film piezoelectric body 526 by performing film forming on another substrate and then peeling and transferring onto the side of the diaphragm 521 and then performing integrated firing. Here, it is supposed that a PZT-based piezoelectric material is used as the thin-film piezoelectric body 526. This piezoelectric material is a material whose linearity is high as the response displacement characteristic of voltage, and therefore, it is preferable to drive the piezoelectric material in a range in which linearity is high. However, in reality; it is inevitable that the polarization saturation characteristic and the electrostrictive non-linear characteristic intermingle with the displacement characteristic.

As an electrode 527, a Pt-based material is used in a case of being subjected to the firing process, but it may also be possible to use an AL-based material in a case where the firing process can be separated. In the present embodiment, as the diaphragm 521, an SOI substrate of about 1 to 2 μm is used. The electrode 527 on the side of the diaphragm 521 is formed by combining a Ti layer and a Pt layer. The thin-film piezoelectric body 526 is formed by a PZT layer of about 1 to 3 μm. The electrode 527 sandwiching the thin-film piezoelectric body 526 in between and arranged at the position facing the electrode 527 on the side of the diaphragm 521 is formed by a Ti-based alloy and the outermost layer thereof is covered with a SiN-based protective film.

Figure 6:
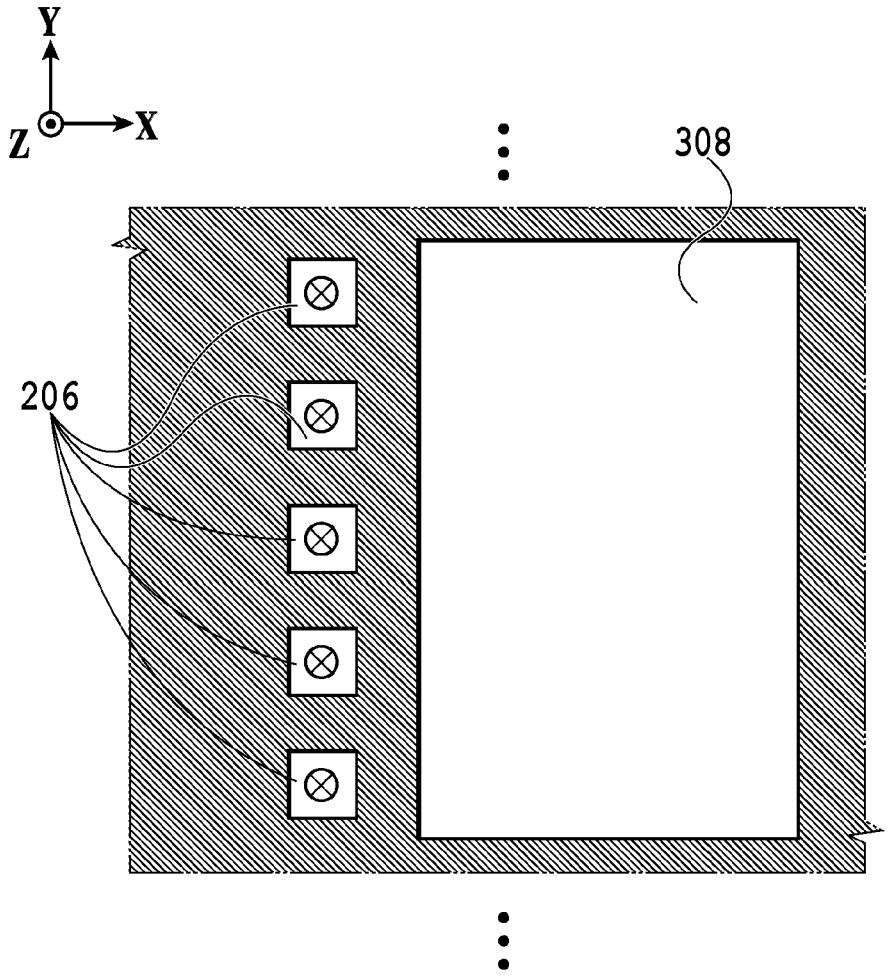
FIG. 6 is a plan perspective diagram of the printing element substrate 106 including the liquid sending mechanism, the first substrate, and the second substrate in the first embodiment.

FIG. 6 is a plan perspective diagram along a VI-VI line in FIG. 5. Here, the area of the diaphragm 521 is about 600 μm (short side)×1,200 μm (long side) at most.

In a case where a voltage is applied to the electrode 527, a distortion due to the thin-film piezoelectric body 526 occurs in the diaphragm 521, In the configuration of the present embodiment, in a case where a design is created that takes into consideration the balance between the amount of rigidness and the amount of displacement of an actuator in view of the flow path load by using a commercially available finite element simulator, the resonance frequency of the entire system is 100 to 200 kHz. The resonance frequency of the entire system is also called the Helmholtz frequency meaning the container resonance. It is possible to derive the Helmholtz resonance frequency by performing the impedance measurement in the ink filled state for each liquid sending device incorporated in the ejection module.

The liquid sending mechanism 308 of the present embodiment is driven by making use of the resonance frequency of the entire system. The liquid sending principle of the valveless pump makes use of the nonlinear change in the flow path resistance in the vortex flow by a fast flow and the laminar flow by a slow flow. Here, in order to suppose 2.5 μs to 5.0 μs as the speed that causes the liquid sending mechanism 308 to expand quickly, 100 to 200 KHz is necessary as the resonance frequency of the entire system.

<Dimension Example of Flow Path Configuration>

In the following, a specific dimension example of the flow path configuration in the present embodiment is explained. In the present embodiment, the following dimension example is taken as a reference, but the dimension value of each part is merely exemplary and it is possible to appropriately change the dimension value in accordance with the required specifications.

Each printing element in the print head 100, that is, the energy generation element 201. the ejection port 202, and the pressure chamber 203 are arrayed in the Y-direction in a density of 1,200 npi (nozzle per inch). The size of the energy generation element 201 is about 32 μm×12 μm. The diameter of the ejection port 202 is about 15 μm and the thickness of the ejection port 202 is about 8 μm, The size of the pressure chamber 203 is about 37 μm in the X-direction (length)×17 μm in the Y-direction (width)×13 μm in the Z-direction (height). The cross-sectional shape of the supply flow path 205 is about 75 μm×75 μm and the length of the supply flow path 205 is about 200 μm. The cross-sectional shape of the collecting channel 206 is about 75 μm×50 μm and the length of the collecting channel 206 is about 200 μm.

The liquid sending chamber 316 is formed by performing anisotropic etching for a Si substrate and its shape on the second substrate 313 is a quadrangular frustum whose bottom is the side on which the liquid sending mechanism 308 is arranged and whose top is the opening plane of the connection flow path 307, The size of the bottom of the quadrangular frustum is about 700 μm (short side)×1,200 μm (long side) at most and the size of the top of the quadrangular frustum is about 30 to 50 μm (short side)×500 μm (long side), The thickness of the Si substrate that forms the liquid sending chamber 316 is about 500 μm, thickness of the ejection port forming member 311 is about 6 μm. The viscosity of the ink that is used is about 3 cP and the amount of ejection ink that is ejected from each ejection port 202 is about 4 pL.

In order to cause a vortex flow to occur that serves as a check valve in the vicinity of the connection flow path 307, it is indispensable to increase the Reynolds number in the connection flow path 307. There is a plurality of variables configuring the Reynolds number, but it is the most effective to increase the flow velocity. Here, the flow velocity is increased by distributing the amount of displacement volume of the liquid sending mechanism 308 to the side of the connection flow path 307 to the maximum and at the same time, reducing the opening of the connection flow path 307. The amount of displacement volume of the liquid sending mechanism 308 is finite, and therefore, in order to obtain the flow velocity that causes a vortex flow to occur in the connection flow path 307, it is necessary to appropriately determine the opening area.

A part of the liquid sending chamber 316, the collecting channel 206, the pressure chamber 203, and the supply flow path 205 in a case where the flow path dimensions shown so far are adopted are taken as a first path. Further, the part of the liquid sending chamber 316, which is not included in the first path, and the connection flow path 307 are taken as a second path, In this case, the inertance of the first path viewed from the liquid sending mechanism 308 is about 20 times the inertance of the second path viewed from the liquid sending mechanism 308.

The inertance of the first path being about 20 times the inertance of the second path means that the drive load of the first path is heavy and the drive load of the second path is light in a case of being viewed from the liquid sending mechanism 308. That is, 95% at most of the amount of displacement volume of the liquid sending mechanism 308 is distributed to the side of the second path.

<Relationship Between Inertance Ratio and Liquid Sending Efficiency>

Figure 7:
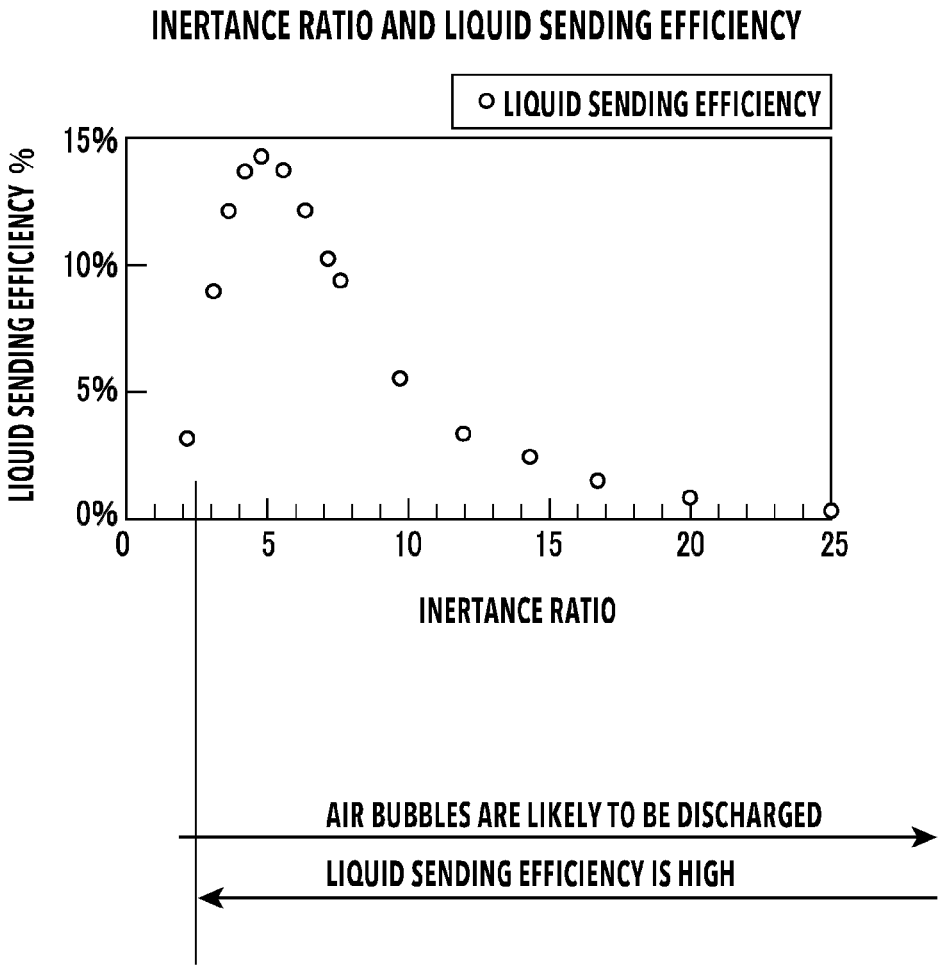
FIG. 7 is a diagram showing a relationship between a flow path inertance ratio and liquid sending efficiency in the first embodiment.

In the following, the relationship between the inertance ratio and the liquid sending efficiency is explained by using FIG. 7. In the following, the inertance ratio refers to the inertance of the first path viewed from the liquid sending mechanism 308/the inertance of the second path viewed from the liquid sending mechanism 308. FIG. 7 is a diagram showing the relationship between the inertance ratio and the liquid sending efficiency. As shown in FIG. 7, in a case where the liquid sending efficiency is increased, there exists an optimum value for the inertance ratio and the optimum value is about 5. However, in order to improve the dischargeability of air bubbles existing within the liquid sending chamber 316, it is preferable to increase the opening area of the connection flow path 307 as much as possible.

The inertance ratio is inversely proportional to the cross-sectional area of the second path. In a case where the opening area of the connection flow path 307 is increased, the inertance of the second path becomes small and the inertance ratio becomes high. In a case where the inertance ratio becomes high, at the time of ink being sent from the second path to the first path via the liquid sending chamber 316, the inertial resistance of the second path is too high, and therefore, the amount of ink that is sucked in from the second path into the liquid sending chamber 316 becomes small. In a case where the inertance is large, generally, the resistance (viscosity resistance, DC resistance) is also high. In this case, the flow rate of ink becomes low. As explained above, the improvement of air-bubble dischargeability and the improvement of the liquid sending performance are contradictory to each other, and therefore, the flow path configuration is selected appropriately in accordance with the purpose.

In the flow path configuration of the present embodiment, in a case where the long side of the opening shape of the connection flow path 307 is 500 μm and the short side is 30 μm, the inertance ratio is about 19 and in a case where the long side of the opening shape of the connection flow path 307 is 500 μm and the short side is 50 μm, the inertance ratio is about 22. As a result of the intensive study by the inventors of the present disclosure, it has been found that in a case where importance is given to liquid sending rather than the air-bubble dischameability, it is preferable for the inertance of the first path to be at least 2.5 times or more the inertance of the second path. Further, it has been found that in a case where liquid sending is performed while giving importance to the air-bubble dischargeability, it is preferable for the inertance of the first path to be 25 times or less the inertance of the second path at most.

<Relationship Between Size of Area Contributing to Displacement and Size of Opening of Connection Flow Path in Liquid Sending Mechanism>

Figure 8:
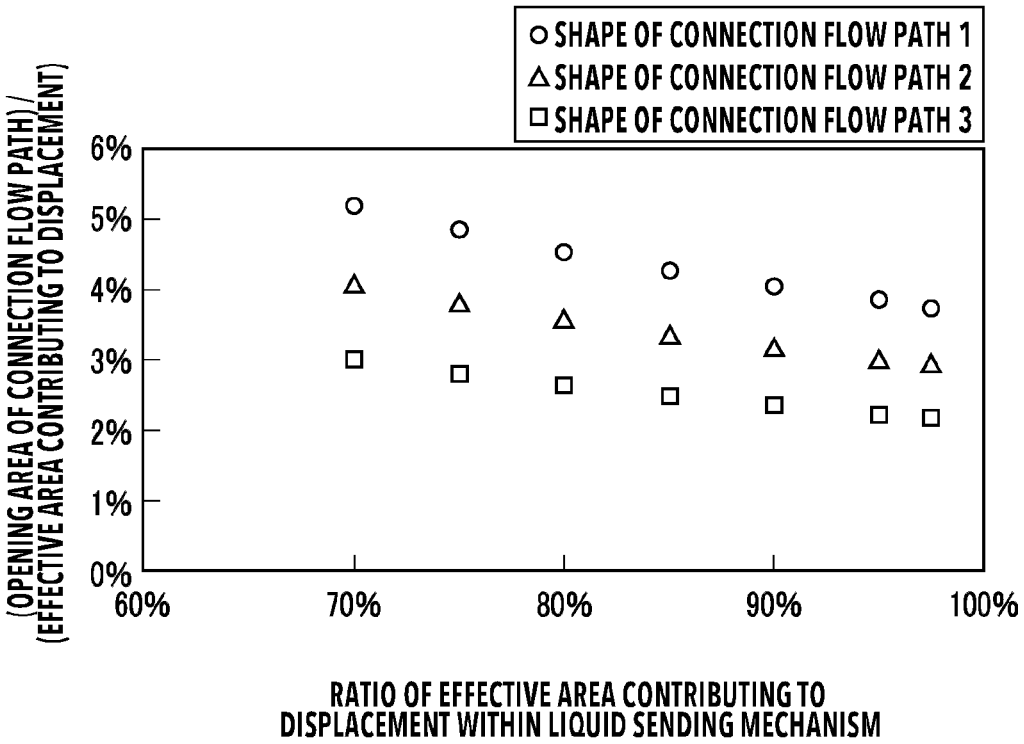

FIG. 8 is a diagram showing a relationship between the size of the area contributing to the displacement and the size of the opening of the connection flow path 307 in the liquid sending mechanism 308, The X-axis in FIG. 8 represents the ratio of the size of the effective area contributing to the displacement in the liquid sending mechanism 308 to the overall size of the liquid sending mechanism 308. In a case where a piezoelectric thin film is used in the liquid sending mechanism 308, the area of the liquid sending mechanism 308, which effictively displaces, is smaller than the overall size of the liquid sending mechanism 308. The reason is that the area that effectively displaces is allocated to part of the areas of the partition bonding unit configured to electrically connect a piezoelectric thin film, route drive wiring, and separate from the adjacent liquid sending mechanism and the liquid sending mechanism 308 that maintains the end portion rigidity of the actuator. Because of this, about 70% to 95% of the liquid sending mechanism 308 is the area that effectively displaces.

The Y-axis in FIG. 8 represents (the opening area of the connection flow path 307)/(the effective area of the liquid sending mechanism 308, which contributes to displacement). Due to the shape of the connection flow path 307, the characteristic ratio indicated by (the opening area of the connection flow path 307)/(the effective area of the liquid sending mechanism 308, which contributes to displacement) has a certain predetermined width. Here, this characteristic ratio indicates 2% to 6% and has a width of about several %.

Here, the plot shown in FIG. 8 indicates part of the design level of the liquid sending mechanism 308 and the connection flow path 307 and. the design of the liquid sending mechanism 308 and the connection flow path 307 is not limited only to this. In view of the level of the structure of the other portions on the printing element substrate 106, it is preferable for the characteristic ratio described previously to be at least not less than 1% and not more than 10% at most. The threshold value 1% is a value derived under the condition that the opening of the connection flow path 307 is not reduced too much and the air-bubble dischargeability is maintained. Further, the threshold value 10% is a value derived under the condition that the opening of the connection flow path 307 is not opened too much and the valveless pump is caused to function.

<Relationship Between Opening Shape of Connection Flow Path and Average Flow Velocity of Ink in the Vicinity of Ejection Port>

FIG. 9 is a diagram showing a relationship between the opening shape of the connection flow path 307 and the average flow velocity of the ink in the vicinity of the nine ejection ports 202, Generally, as a method. of evaluating a flow, methods such as PIV (Particle Image Velocimetry) and PTV (Particle Tracking Velocimetry) are widely known, but it may be possible to perform evaluation by using any one of them. Here, as the method of evaluating the flow of ink, PTV is used. Specifically, the observation and analysis of the flow of the ink in the vicinity (pressure chamber 203) of the ejection port 202 in the state where the ink to which the tracer particles haying a diameter of 1 μm are added and which is stirred is circulated are performed by using an optical microscope and a high-speed camera. From the observation results and the analysis results, the average velocity of the ink in the vicinity of the nine ejection ports 202 is derived. The ejection port forming member 311 is optically transparent, and therefore, it is possible to observe the tracer particle flowing within the pressure chamber 203 by using the optical microscope and the high-speed camera.

The flow of ink is evaluated for three kinds of the connection flow path 307 whose opening shapes are different. As the opening shape of each of the three kinds of the connection flow path 307, the long side is set to about 500 μm for the three kinds and the short side is set to 30, 40, and 50 μm, respectively. As the drive voltage conditions, two kinds of condition, that is, condition A and condition B are set. The condition A is that −30 V is applied as the DC-BIAS voltage, the rise time is set to 3 μs, the fall time is set to 47 μs, and a sawtooth waveform is repeated at a frequency of 20 KHz. Under the condition A, as the value on the X-axis (short side of the connection flow path 307) becomes smaller from 50 μm to 30 μm, the flow velocity of the ink observed in the vicinity of the ejection port 202 increases from 1 mm/s to 4 mm/s.

The condition B is the condition whose voltage value is 1.5 times that of the condition A and the rest is the same as that of the first condition A. Under the condition B, as the value on the X-axis becomes smaller from 50 μm to 30 μm, the flow velocity of the ink observed in the vicinity of the ejection port 202 increases from 2 mm/s to 11 mm/s, the increasing rate being higher than that under the condition A.

Here, in order to obtain the improvement effect of the ejection characteristic by the circulation of ink, it is preferable for the flow velocity in the vicinity of the ejection port 202 at the time of ink circulation to be about 1 mm/s to 10 mm/s. The liquid sending device of the present embodiment may be a single unit or a device obtained by combining a plurality of single units. For example, as the liquid sending device, it may also be possible to arrange one large device, or arrange a plurality of small devices, or arrange a plurality of devices whose sizes are different, <Stability of Ejection Speed>

In order to evaluate the liquid sending ability of the liquid sending mechanism 308 incorporated in the print head 100, the stability of the ejection speed of ink in a case where the ejection starts from the suspension period is evaluated. The ink whose viscosity is 3 cps is used. The drive condition is that −30 V is applied as the DC-BIAS voltage, the rise time is set to 3 μs, the fall time is set to 47 μs, and a sawtooth waveform is repeated at a frequency of 20 KHz. Under this condition, the liquid sending device is driven. In this case, even though the suspension period is taken to be several seconds to several tens of seconds, the instability is not found in the ink ejection speed and the ejection port 202 that does not eject the ink droplets 301 is not found.

Effects of the Present Embodiment

In the configuration in which the sidewall of the liquid sending chamber 316 has a continuously inclined structure, in a case where the liquid sending device is incorporated in each printing element and ink is circulated, it is possible to suppress the air bubbles 302 from being trapped by the sidewall of the liquid sending chamber 316. Due to this, it is made possible to stably circulate the ink in the vicinity of the ejection port 202 within each printing element. As a result of that, it is possible to suppress the ejection failure resulting from the increase in the viscosity of ink due to ink evaporation at the ink ejection portion and improve the characteristic of the initial ejection.

Second Embodiment

In the present embodiment, the printing elements are arranged in 1,200 npi×two rows, that is, arranged in a density higher than that of the first embodiment. FIG. 10 is a cross-sectional diagram of the printing element substrate 106 in the present embodiment. As shown in FIG. 10, in the present embodiment, the supply flow path 205 is shared by ejection port rows. The liquid sending mechanism 308 is arranged appropriately for each ejection port row. The present embodiment differs from the first embodiment in that the supply flow path 205 is shared by the two ejection port rows.

<Relationship Between Opening Shape of Connection Flow Path and Average Flow Velocity of Ink in the Vicinity of Ejection Port>

As in the first embodiment, the flow velocity of the ink in the vicinity of the ejection port 202 is evaluated by using PTV as the method. of evaluating the flow of ink. The observation and analysis for the flow of the ink in the vicinity (pressure chamber 203) of the nine ejection ports 202 are performed in the state where the ink is circulated and the average flow velocity of the ink in the vicinity of the ejection port 202 is derived. FIG. 11 shows a relationship between the opening shape of the connection flow path 307 and the average flow velocity of the ink in the vicinity of the nine ejection ports 202 in the present embodiment.

The flow of ink is evaluated for three kinds of the connection flow path 307 whose opening shapes are different. As the opening shape of each of the three kinds of the connection flow path 307, the long side is set to about 500 um for the three kinds and the short side is set to 20, 30, and 50 μm, respectively. As the drive voltage conditions, two kinds of condition, that is, condition C and condition D are set. The condition C is that −30 V is applied as the DC-BIAS voltage, the rise time is set to 3 μs, the time during which the state after the rise is maintained is set to 10 μs, the fall time is set to 37 μs, and a sawtooth waveform is repeated at a frequency of 20 KHz. Under the condition C, as the value on the X-axis (short side of the connection flow path 307) becomes smaller from 50 to 20 μm, the flow velocity that is observed at the ejection port 202 increases from slightly less than 1 mm/s to about 1 mm/s.

The condition D is the condition whose voltage value is 1.5 times that of the condition C and the rest is the same as that of the condition C. Under the condition D, as the value on the X-axis becomes smaller from 50 μm to 20 μm, the flow velocity that is observed at the ejection port 202 increases from slightly less than 1 mm/s to about 3 mm/s. By the above, in the configuration in the present embodiment, it is possible to set the flow velocity in the vicinity (pressure chamber 203) of the ejection port 202 at the time of ink circulation to 1 mm/s or higher.

The reason the flow velocity in the vicinity (pressure chamber 203) of the ejection port 202 at the time of ink circulation is low in the present embodiment compared to that in the first embodiment is that the two liquid sending mechanisms 308 are arranged between the colors despite that the color-to-color distance of the present embodiment is the same as that of the first embodiment. As a result of this, the arrangement area of the liquid. sending mechanism 308 becomes small compared to that of the first embodiment and the absolute amount of displacement volume of the liquid sending mechanism 308 becomes small. Because of this, it becomes difficult to cause a fast flow to occur in the vicinity of the connection flow path 307, and therefore, the degree of the vortex flow becomes weak.

<Stability of Ejection Speed>

Here, as in the first embodiment, in order to evaluate the liquid sending ability of the liquid sending mechanism 308 incorporated in the print head 100, the stability of the ejection speed of ink in a case where the ejection starts from the suspension period is evaluated. As a result of this evaluation, even though the suspension period is taken to be sufficiently long, the instability is not found in the ink ejection speed and the ejection port 202 that does not eject the ink droplets 301 is not found.

Effects of the Present Embodiment

The supply flow path 205 is shared by the ejection port rows and in the two rows of the ejection port 202 in each of which the liquid sending mechanism 308 is arranged, it is possible to suppress the ejection failure resulting from the increase in the viscosity of ink due to ink evaporation at the ink ejection portion and improve the characteristic of the initial ejection.

According to one embodiment of the present disclosure, it is possible to provide a liquid ejection module capable of discharging air bubbles from the flow path and performing a stable ejection operation while circulating and supplying fresh ink in the vicinity of the ejection portion.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2020-106032, filed Jun. 19, 2020, which is hereby incorporated by reference wherein in its entirety.

What is claimed is:

1. A liquid ejection module comprising:

a pressure chamber that communicates with an ejection port and which stores a liquid ejected from the ejection port;

an energy generation element that is provided in the pressure chamber and which produces energy for causing a liquid to be ejected from the ejection port;

a supply flow path that supplies a liquid to the pressure chamber;

a collecting channel that collects a liquid from the pressure chamber;

a liquid sending chamber that connects to the collecting channel;

a connection flow path that connects the liquid sending chamber and the supply flow path; and a liquid sending unit configured to circulate a liquid in the supply flow path, the pressure chamber, the collecting channel, the liquid sending chamber, and the connection flow path by expanding and contracting a volume of the liquid sending chamber, wherein the liquid sending chamber has a continuously inclined structure, in the liquid sending chamber, a cross-sectional area in a cross section parallel to a plane perpendicular to a gravity direction becomes smaller along a direction opposite to the gravity direction, and a portion at which the cross-sectional area becomes the smallest is a portion that connects to the connection flow path.

2. The liquid ejection module according to claim 1, wherein the liquid sending unit is arranged at a position facing an opening position of the connection flow path so as to sandwich the liquid sending chamber.

3. The liquid ejection module according to claim 1, wherein the collecting channel is arranged at a position closer to the liquid sending unit than to the connection flow path.

4. The liquid ejection module according to claim 1, wherein inertance of, in a case of being viewed from the liquid sending unit, the supply flow path, the pressure chamber, the collecting channel, and part of the liquid sending chamber is not less than 2.5 times and not more than 25 times inertance of, in a case of being viewed from the liquid sending unit, the rest that is not the part of the liquid sending chamber and the connection flow path.

5. The liquid ejection module according to claim 1, wherein the liquid sending unit has a configuration including an actuator consisting of a piezoelectric element or an electrostrictive element.

6. The liquid ejection module according to claim 5, wherein an opening area of the connection flow path is at least 1% or more and 10% or less at most for an area of the actuator consisting of a piezoelectric element or an electrostrictive element, which configures the liquid sending unit.

7. The liquid ejection module according to claim 1, wherein an inclination angle of the inclined structure in the liquid sending chamber is not less than 30° and not more than 60° for a surface at which the liquid sending unit is arranged.

8. The liquid ejection module according to claim 1, wherein the inclined structure in the liquid sending chamber is configured by a (111) plane of a Si single crystal substrate.

9. The liquid ejection module according to claim 1, further comprising:

a common supply flow path that supplies ink to the plurality of supply flow paths, wherein the common supply flow path has a sidewall substantially parallel to a wall surface of the liquid sending chamber.

10. The liquid ejection module according to claim 1, further comprising:

a first ejection port row; and a second ejection port row, wherein the ejection port in the first ejection port row and the ejection port in the second ejection port row share the supply flow path.

* * * * *